United States Patent [19]

Nichols

[11] Patent Number: 4,960,265

[45] Date of Patent: Oct. 2, 1990

[54] DEVICES FOR APPLYING PRESSURE TO A CLOSED DOOR

[75] Inventor: Peter W. Nichols, Nottinghamshire, Great Britain

[73] Assignee: Nichols Hydraulic Products, Ltd., Newark, United Kingdom

[21] Appl. No.: 192,718

[22] Filed: May 11, 1988

[30] Foreign Application Priority Data

May 14, 1987 [GB] United Kingdom ..... 8711378

[51] Int. Cl.[5] ..... B66F 3/24

[52] U.S. Cl. ..... 254/93 R; 254/133 R; 72/705; 29/239

[58] Field of Search ..... 254/93 R, 133 R, DIG. 4, 254/39, 32; 29/239; 72/705; 91/536

[56] References Cited

U.S. PATENT DOCUMENTS 3,295,330 1/1967 Meshorer ..... 254/93 R
4,664,364 5/1987 Lymburner ..... 269/32
4,762,304 9/1988 Hill ..... 254/93 R

FOREIGN PATENT DOCUMENTS 217834 9/1956 Netherlands ..... 254/93 R
2189544 10/1987 United Kingdom .

*Primary Examiner*—J. J. Hartman
*Attorney, Agent, or Firm*—Lorusso & Loud

[57] ABSTRACT

A jack for opening locked or barricaded doors has a first hydraulic single acting piston and cylinder actuator mounted on a casing by which holding claws are forces into engagement with a door frame to hold the jack in place. An arm is pivotted on the casing and an end opposite the pivot forced against the door by a second hydraulic single acting piston and cylinder actuator to open the door, reaction to the opening force being transmitted to the door frame through the casing and claws. The reservoir for the hydraulic fluid is provided to the rear of the piston of the actuator. The jack is readily portable and self-contained, and does not present a significant obstacle to entry through a door which has been forced using the jack.

1 Claim, 6 Drawing Sheets

DEVICES FOR APPLYING PRESSURE TO A CLOSED DOOR

FIELD OF THE INVENTION

This invention relates to devices for applying pressure to a closed door especially to inwardly opening doors which have been barricaded, to force the door open.

In some circumstances, for example in prisons, police cells, mental hospitals, and elsewhere, it may be necessary to apply pressure to open doors which have been locked or barricaded. Apparatus has been proposed for this purpose but the known apparatus is extremely heavy and cumbersome of such a weight and dimension that it is necessary to transport the equipment on a suitable barrow. In an emergency where it is necessary to force open barricaded or locked doors rapidly, for example in prisons, the existing equipment has been too cumbersome and very unsatisfactory especially, as is the case in many prisons, where the doors which may need to be forced open are on first, second or higher floors but the equipment, for security reasons, is stored under lock and key on the ground floor. In addition to being cumbersome and difficult to use rapidly, the known equipment has also by virtue of its construction, provided a considerable obstruction in a doorway once the door has been forced open to some extent so that entry into a room which has been locked or barricaded is hazardous for the person attempting to enter the room.

SUMMARY OF THE INVENTION

One of the objects of the present invention is to provide an improved device for applying pressure to a closed door to force it open.

There are hereinafter described in detail to illustrate the invention by way of example two devices, namely door jacks, for applying pressure to a closed door. The illustrative jacks each comprise a main frame, namely a casing, to which a first engaging member, namely a fixed claw, is secured; the fixed claw is so arranged as to engage a door frame between the closed door and the frame itself when the door jack is presented to the door. Each jack further comprises a first hydraulic actuator on the frame and a second engaging member, namely a movable claw, mounted for movement by the first hydraulic actuator to urge the fixed and movable claws into the space between the closed door and the door frame at opposite sides of the door. An arm is mounted on the casing for pivotal movement between a retracted position and an operative position in which the arm projects beyond the plane defined by the two claws and a second hydraulic actuator on the casing is adapted to pivot the arm from its retracted position to its operative position whereby to urge an end portion of the arm against the door to apply force to the door urging it open.

In these illustrative door jacks the first hydraulic actuator comprises a piston and cylinder, the moving claw being mounted on the piston rod, or on an extension thereof, for movement in a direction away from the fixed claw under pressure from the first actuator so that the claws can be urged firmly into the space between the door frame and the door and the jacks also comprises first spring means by which the moving claw is urged towards a retracted position whereby on release of hydraulic pressure from the first actuator the moving claw is retracted towards the fixed claw to a retracted position. The second hydraulic actuator of each of the illustrative jacks also comprises a piston and cylinder, the jack comprising second spring means arranged so that the piston rod of the second actuator is urged by the second spring means to an extended position in which the arm of the jack is in its retracted position, supply of hydraulic fluid to the cylinder of the second hydraulic actuator retracting the piston rod so that the arm is urged against the pressure of the second spring means to its operative position; thus, on release of hydraulic pressure the arm is moved to its retracted position.

The illustrative jacks each comprise a reservoir for the hydraulic fluid provided in the cylinder of the second hydraulic actuator at the side of the piston remote from the piston rod; each jack also comprises a valve which, when closed, permits operation of the first and second hydraulic actuators to urge the claws and the arm to their operative positions but, when open, releases hydraulic fluid whereby the claws, and arm are returned to their retracted positions by the associated spring means, the hydraulic fluid returning to the reservoir.

In a first illustrative jack the hydraulic fluid is supplied to the first and second hydraulic actuators by first and second pump means which are manually operated, conveniently by an operating handle which, when not in use for operating the pump means may be secured to the casing to serve as, a carrying handle for the device when the device is, not in use. Preferably each pump means comprises a lever system by which the pump is operated, including means by which the operating handle may be connected to the lever system to operate the pump.

In a second illustrative jack a single pump is arranged to supply both actuators through an ingenious control valve system which is adapted to ensure that the first actuator is operated to firmly engage the claws between the door and frame before the second actuator is operated.

In one aspect the invention provides a device suitable for use in applying pressure to a closed door comprising a main frame, a first engaging member secured to the main frame so arranged as to engage a door frame when the device is presented to the door, a first hydraulic actuator mounted on the main frame, a second engaging member mounted for movement by the first actuator to urge said second engaging member into engagement with the door frame at the opposite side of the door to the first member, an arm mounted on the main frame for pivotal movement between a retracted position and an operative position in which the arm projects beyond the plane defined by the engaging members, and a second hydraulic actuator adapted to pivot the arm from its retracted position to its operative position whereby to urge an end portion of the arm into engagement with a door and to apply a force to the door urging it open, the reaction of the force being transmitted to the door frame through the engaging members.

There now follows a detailed description, to be read with reference to the accompanying drawings of two door jacks embodying the invention. It will be realized that these door jacks have been selected for description to illustrate the invention by way of example.

DESCRIPTION OF THE PREFERRED EMBODIMENTS

Figure 2:
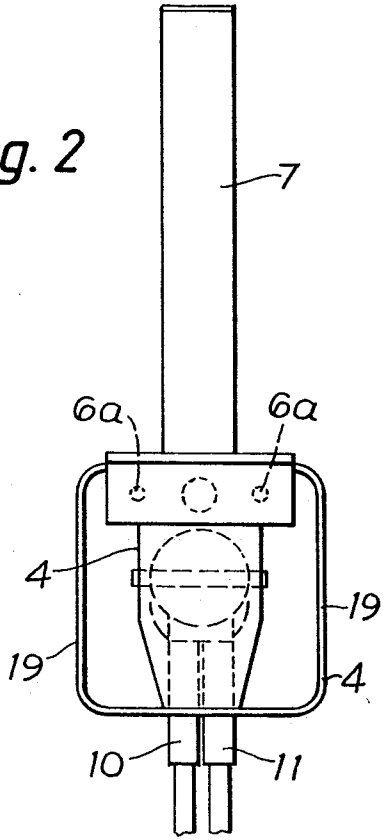
FIG. 2 is an end view of the door jack shown in FIG. 1.

The two illustrative jacks described hereinafter are both suitable for use in applying pressure to a closed door. In the following description and in the drawings, like reference characters are used to indicate like parts.

Figure 1:
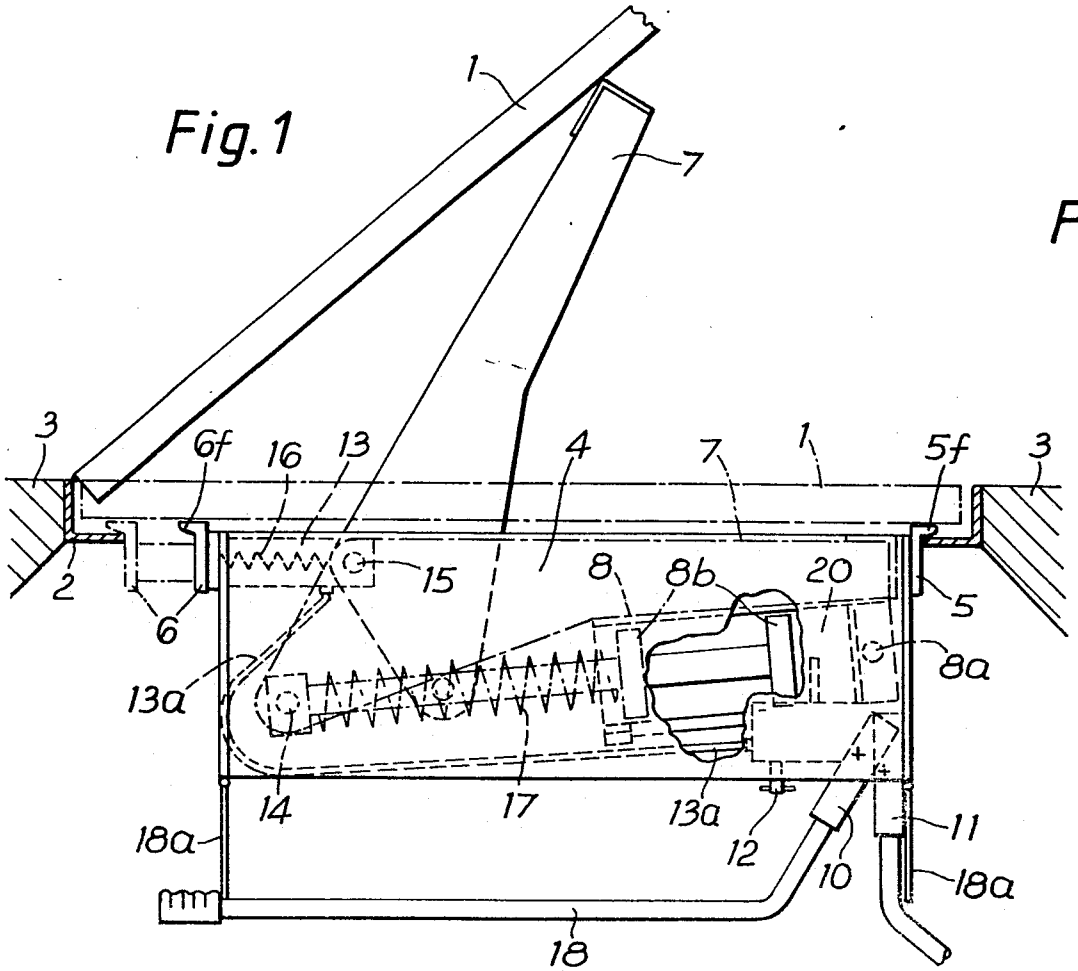
FIG. 1 is a view, partly in section, showing a first illustrative door jack presented to a door.

Referring to FIG. 1 the first illustrative door jack is shown presented to a door system comprising a steel angle-iron frame 2 secured to walls 3, for example in a prison cell. A door 1 is shown in FIG. 1 in dot-dash line in a closed position and, in full line, partially open. Door 1 is hinged at the left viewing FIG. 1 but it will be appreciated that the first illustrative door jack may be used to open a door irrespective of which side the door is hinged at: the jack may be used to open a door hinged at the right merely by turning it through 180° so that it is inverted i.e. the movable claw 6 is always at the hinge end.

The first illustrative door jack comprises a main frame comprising a welded steel casing 4. A fixed claw 5 is secured to the casing 4 at the right hand end portion (viewing FIG. 1). A movable claw 6, shown in FIG. 1 in full line in a retracted condition and in dash line in an extended operative condition is secured to the piston rod of a first hydraulic piston and cylinder actuator 13, the cylinder of which is secured to the frame. The movable claw 6 is disposed at the opposite end of the casing 4 to the fixed claw 5; both of the claws comprise a finger 5*f*, 6*f* of generally wedge-shaped configuration adapted to be inserted between the door frame 2 and the closed door 1 as can be seen from FIG. 1. Two guide rods 6*a* are disposed parallel with and one at either side of the piston rod of the first hydraulic actuator to ensure that the movable claw moves linearly along its path. The first hydraulic actuator 13 is a single acting actuator and a first spring 16 is provided extending between the movable claw 6 and the frame, urging the movable claw 6 to the retracted position in which it is shown in full line in FIG. 1. The movable claw 6 is urged towards its extended operative condition by admission of hydraulic fluid under pressure through a pipe 13*a*.

A second hydraulic actuator 8 comprises a single acting cylinder pivotally mounted on the casing 4 at 8*a*. The piston of the second actuator 8 is connected by a pivot pin 14 to a bush in the arm 7 which is mounted for pivotal movement on an axle 15 mounted in the casing 4 between a retracted, inoperative position in which it is housed in the casing 4 (shown in dash-dot line in FIG. 1) to an operative position in which it is, shown in full line in FIG. 1.

The piston rod of the second actuator 8 is urged to its extended condition by a second spring 17; by supply of hydraulic fluid under pressure in front of the piston 8*b* of the actuator the piston 8*b* is urged rearwardly in the cylinder thus retracting the piston rod, towards the full line position in FIG. 1. Retraction of the piston rod is effected to pivot the arm 7 about the axle 15 from the retracted position to the operative position in which it is shown in full line in FIG. 1.

The first illustrative door jack further comprises first and second pumps 10, 11 secured to the piston of the second hydraulic actuator 8. The pump 10 is arranged, when operated, to pump hydraulic fluid from a reservoir 20 behind the piston 8*b* of the second actuator 8 to the pipe 13*a* to the first hydraulic actuator 13. The second pump 11 is arranged to pump hydraulic fluid from the reservoir 20 behind the piston 8*b* in the cylinder of the second hydraulic actuator 8 to the chamber in front of the piston 8*b* whereby to urge the piston rod rearwardly in the cylinder and thereby retract the piston. The pumps, 10, 11 are arranged to be operated in the use of the first illustrative door jack, by an operating handle 18 which is secured to operating lever mechanize of the relevant pump, by the operator in order to move the operating lever mechanize and thereby pump hydraulic fluid. When not in use the handle 18 is secured to handle brackets. 18*a* attached to the casing, the door jack being carried by the operating handle 18, mounted in the carrying brackets 18*a*, when not in use.

The first illustrative door jack also has a by-pass valve 12 which can be operated by the user of the jack. The by-pass valve 12 is, when the jack is not in use, kept in an open condition so that hydraulic fluid is allowed to escape from the cylinders of the motors 8, 13 back to the reservoir 20, being urged from the cylinders by action of the springs 16, 17 urging the movable claw 6 and the arm 7 to the retracted positions.

The first illustrative jack also comprises handles 19 by which it is held whilst it is being presented to a door 1 to be opened.

Figure 3:
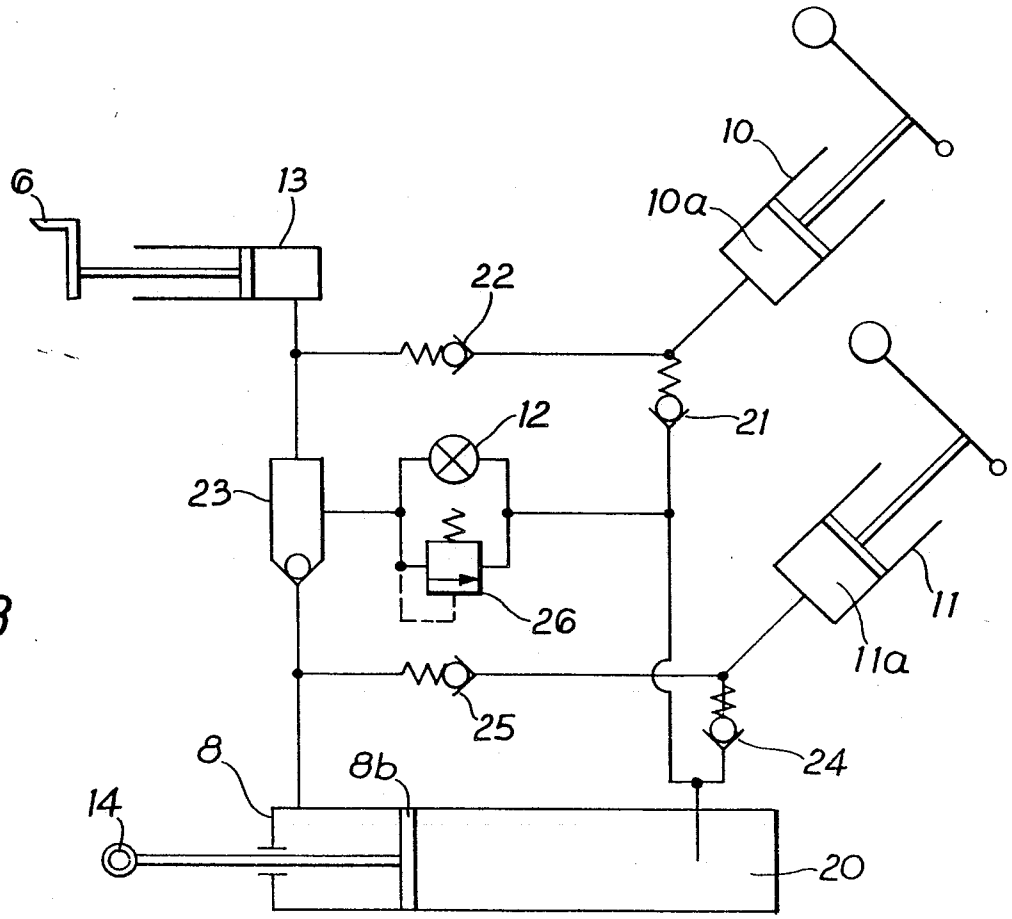
FIG. 3 is a hydraulic circuit diagram showing the hydraulic circuitry of the illustrative door jack.

In the use of the first illustrative door jack, the jack is presented to the door with the finger of the fixed claw 5 engaging between the door frame 2 and the door itself, as shown in full line in FIG. 1, the movable claw likewise being in its full line position. Before presenting the jack to the door the by-pass valve 12 will have been closed and the operating handle 18 will have been connected to the operating lever mechanism of the pump 10. The pump 10 will then be operated by the operating lever 18 to draw hydraulic fluid from the reservoir 20 (see FIG. 3) through a spring-loaded check valve 21 into chamber 10*a* of the pump 10 in front of the piston and to force the hydraulic fluid drawn into the chamber 10*a*, from the chamber passed a spring-loaded check valve 22 into the cylinder 13, to force the piston along the cylinder 13, against the action of the springs 16 and thereby urge the movable claw 6 into the space between the door 1 and frame 2 and, at the same time, to urge the fixed claw 5 into the space between the door 1 and frame 2 at the opposite side of the door. The operation of the hand pump 10 extends the piston rod from the cylinder 13 until the claws. 5, 6 are driven firmly into place between the door 1 and the frame 2 at the opposite sides thereof. When the claws. 5, 6 are firmly in place, the handle is transferred to the hand pump 11 and operated to draw hydraulic fluid from the reservoir 20 through a spring-loaded check valve 24 into a chamber 11*a* of the hand pump 11 then, on the return stroke of the hand pump 11, to drive the hydraulic fluid from the chamber 11*a* through a spring-loaded check valve 25 into a chamber of the second hydraulic actuator 8 in front of the piston 8*b* (that is, at the opposite side of the piston to the reservoir 20). The hand pump 11 gradually forces the piston 8*b* rearwardly in the chamber thereby retracting the piston rod and moving the arm 7 about the axle 15 in a counterclockwise direction (viewing FIG. 1). The outer extremity-of the arm 7 is forced against the door 1 and the pressure applied gradually forces, the door 1 open against the barricade (or if the door is locked by breaking the lock).

As pressure increases in the cylinder of the second actuator 8, the pressures at either side of a check valve 23 positioned in a pipe connecting the pressurized chambers of the first and second hydraulic actuators. 13, 8 become equal and when the pressure applied to the operating chamber of the cylinder of the second actuator 8 exceeds the hydraulic pressure of the first actuator 13, the check valve opens to apply increased pressure to the cylinder of the first hydraulic actuator, thereby increasing the pressures holding the claws 5, 6 in position and ensuring that the forces required to open the door 1 do not dislodge the door jack from the door frame 2. However, should rapid depressurization of the cylinder of the second actuator 8 occur, for example if the barricade breaks or weakens suddenly, the check valve 23 will maintain the pressure in the cylinder of the first actuator 13 thereby holding the claws 5, 6 firmly in place.

A safety relief valve 26 is provided which is set to open at a pressure above that required normally to open the doors against barricades which are likely to be met and which pressure represents the maximum safe pressure of the system. Conveniently the safety valve 26 is pilot operated and spring returned.

When the door has been opened sufficiently and it is wished to remove the first illustrative door jack from the opening, the by-pass valve 12 is opened, using the lever supplied, thus allowing hydraulic fluid to return to the reservoir 20, the fluid being driven from the first and second actuators. 13, 8 by the first and second springs 16, 17.

When the first pump 10 is operated, with the by-pass valve 12 closed, to move the claws. 5, 6 into engagement of the door frame 2 the hydraulic fluid removed from the reservoir 20 will cause some cavitation of the hydraulic fluid in the reservoir 20, the spring 17 being of sufficient strength to prevent any significant movement of the piston 8*b*: in fact pressure drop in the hydraulic fluid in the reservoir 20 will amount to only about two lbs per square inch below atmospheric (that is about 13790 pascals. When the second pump 11 is operated to operate the second hydraulic actuator 8, the volume of the piston rod of the second actuator is such that this tends to compensate for the cavitation of the reservoir 20 caused by operation of the first pump 10 so that when the piston 8*b* reaches its permitted extremity of rearward travel in the cylinder of the second actuator 8 the hydraulic pressure in the reservoir 20 has returned to atmospheric pressure and no significant cavitation remains.

Where the opening in the door frame is about 635 mm (for example in the case of a prison door) the tips of the claws 5, 6 are spaced about 625 mm apart when the door jack is in its fully closed position. In order to open a door of this type of dimension against the loads which may be used to barricade the door (in the case of prison doors this may be the steel bed frame or two steel bed frames suitably positioned, or a combination of bed frames cupboard and other items in a prison cell) the load necessary to open the door, applied to the leading edge of the door may be as much as 1.5 tonnes. The first illustrative door jack is arranged to open a door of the dimensions mentioned above so that the opening reaches about half a metre, sufficient to allow a person to enter and also of sufficient dimension to receive a riot shield of the usual size.

As mentioned above, after use of the first illustrative door jack, opening the by-pass valve 12 connects pressurized fluid in the first and second hydraulic actuators 13, 8 to the reservoir 20 allowing the springs 16, 17 to move the operative parts of the first illustrative jack to retracted positions, the arm 7 moving in a clockwise direction to the retracted position in which it is shown in dot-dash lines in FIG. 1 and the movable claw 6 retracting to the position in which it is shown in full line in FIG. 1 so that the illustrative door jack is automatically returned to its stowed condition for transportation and storage after use. It will be noted that, when in use, when the movable claw 6 has been moved into its operative condition to urge the claw 6 and the claw 5 firmly into engagement with a door frame, the hydraulic fluid contained in the cylinder of the first hydraulic actuator 13 is locked in position by the check valves 22, 23 and the relief valve 26 when the by-pass valve 12 is in its closed condition.

The second illustrative door jack is generally similar to the first illustrative door jack except as hereinafter described and like numbers indicate like parts.

To increase longitudinal stiffness of the second illustrative door jack and to provide ready adjustment for covering a wide range of door widths the hydraulic actuator 13 is mounted adjacent the fixed claw 5. The actuator 13 is housed within a rigid box section 100 which is secured to the casing 4 and extends the length thereof. This rigid box section 100 provides additional strength to the jack as well as providing a guide way for an extension 102 secured to the piston rod of the actuator 13. The movable claw 6 is secured to the outer end of the extension 102 (see FIG. 4) so that the claws 5, 6 are at opposite ends of the second illustrative door jack. A roller 103 is mounted on the arm 102 remote from the trunnions 108 for engagement with a door 1 when the second illustrative jack is in use. A single concentric tension spring 104 surrounds the cylindrical housing of the actuator 13 and is secured at one end to the housing and at the other end to the piston rod of the actuator 13, conveniently by screwing end portions of the spring onto correspondingly threaded parts of the housing and the piston rod. The spring 104 replaces the springs 16 of the first illustrative door jack.

Figure 4:
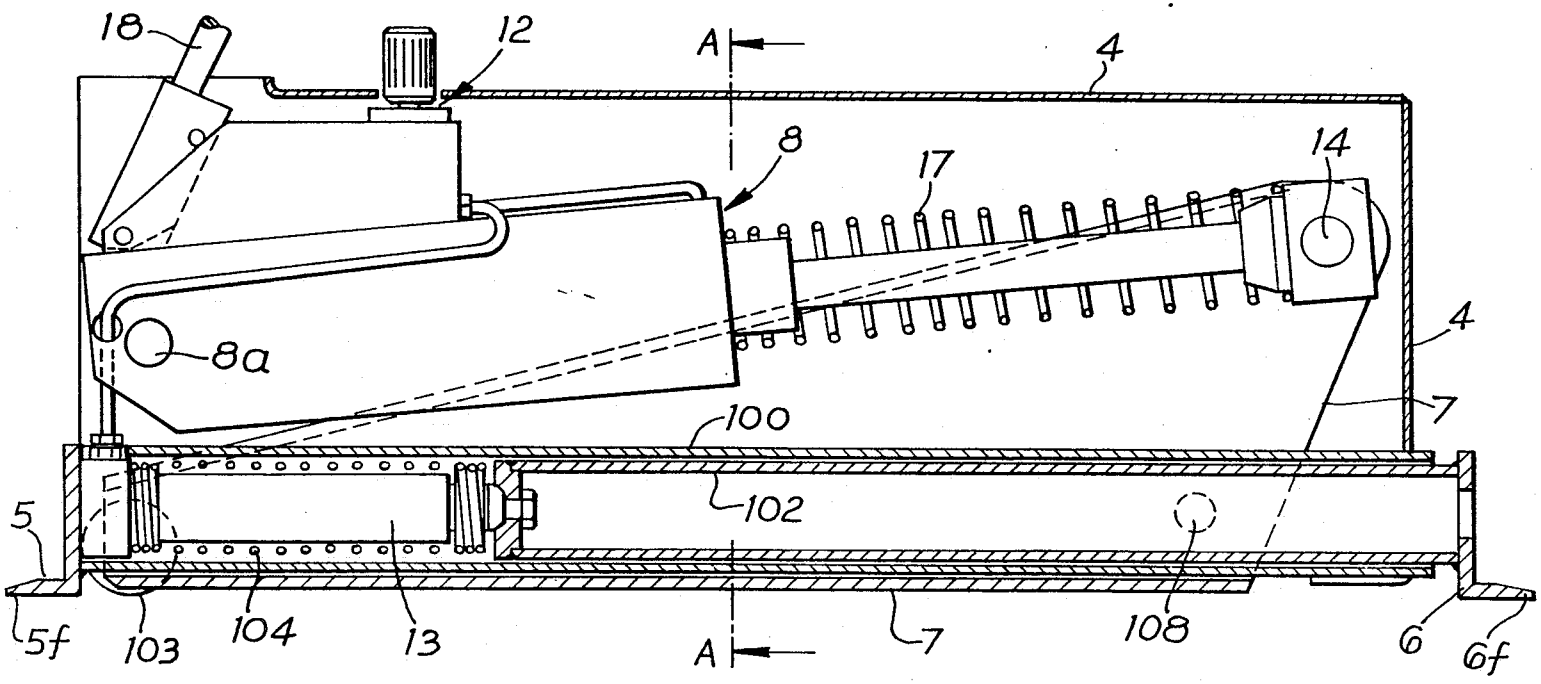
FIG. 4 is a plan view of a second illustrative jack.

The extension 102 shown in FIG. 4 is a single box section of fixed length; however, the extension 102 may be telescopic so that the length of the extension 102 may be adjusted to fit the second illustrative door jack for use with a variety of different width doors bearing in mind that, for efficiency, it is desirable that the stroke of the actuator 13 should not exceed 10 cms. Means may be provided for readily exchanging the extension 102 for one of a different length or providing a telescopic extension consisting of two (or more) box sections one (or each) slidably mounted within the other(s). A series of holes may be provided transversely of one of the sections and a single pair of opposed holes provided in the outer one (where the extension consists of two parts only) of the sections of the extension 102 to permit a pin to be passed through the holes in the outer sections and through one of the sets of holes in the inner section to secure the two sections together: thus the extension 102 can be adjusted to a desired length.

Figure 5:
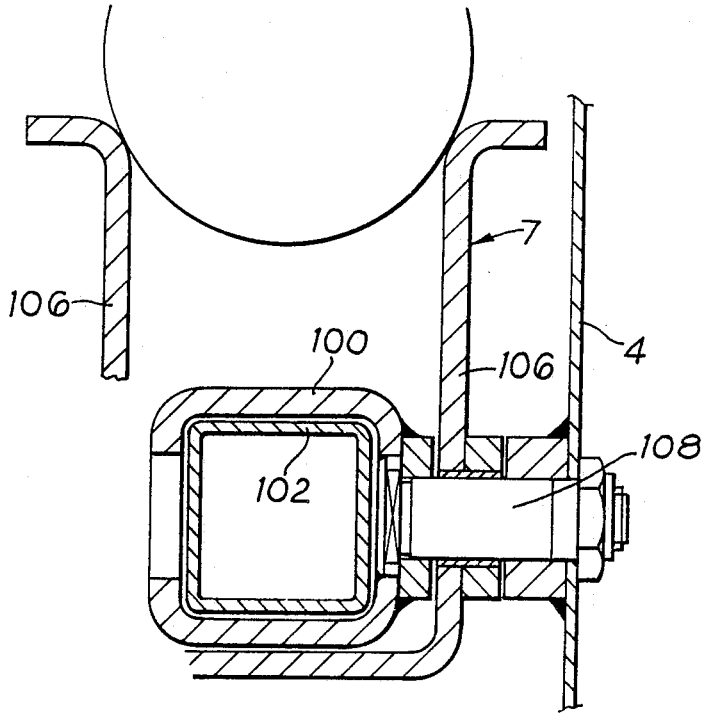
FIG. 5 is a view in section, with parts broken away, on the line A—A of FIG. 4.

As the box section 100 extends the length of the second illustrative door jack, the pivoting arm 7 is constructed of a top hat section 106 (see FIG. 5), instead of a box section as in the first illustrative door jack. Likewise, the single axle 15 on which the arm 7 of the first illustrative door jack is mounted for pivotal movement is replaced by a pair of trunnions 108 (see FIG. 5) extending between the casing 4 and the box section 100.

Figure 6:
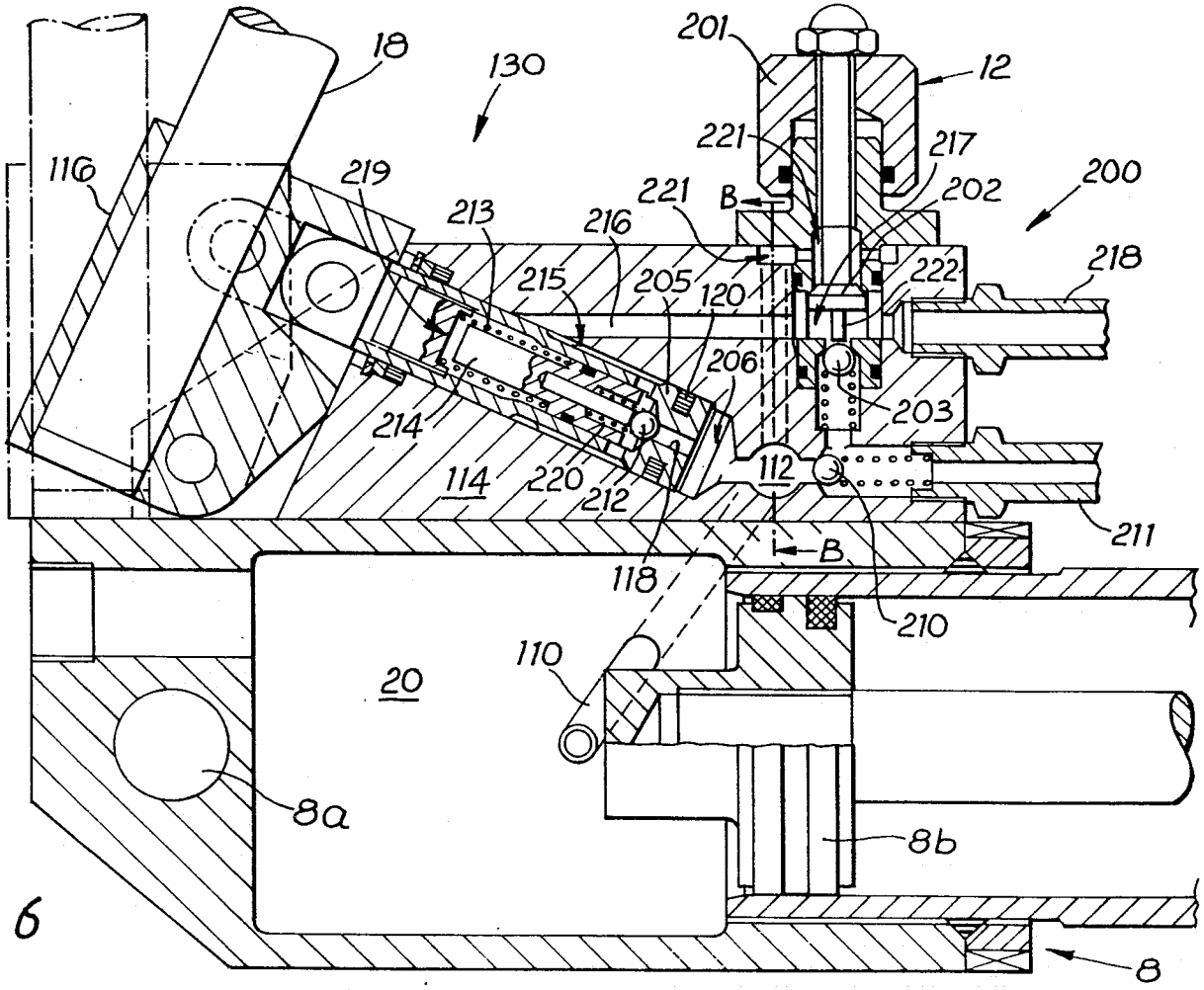
FIG. 6 is a fragmentary view in section showing a control valve system of the second illustrative jack.
Figure 7:
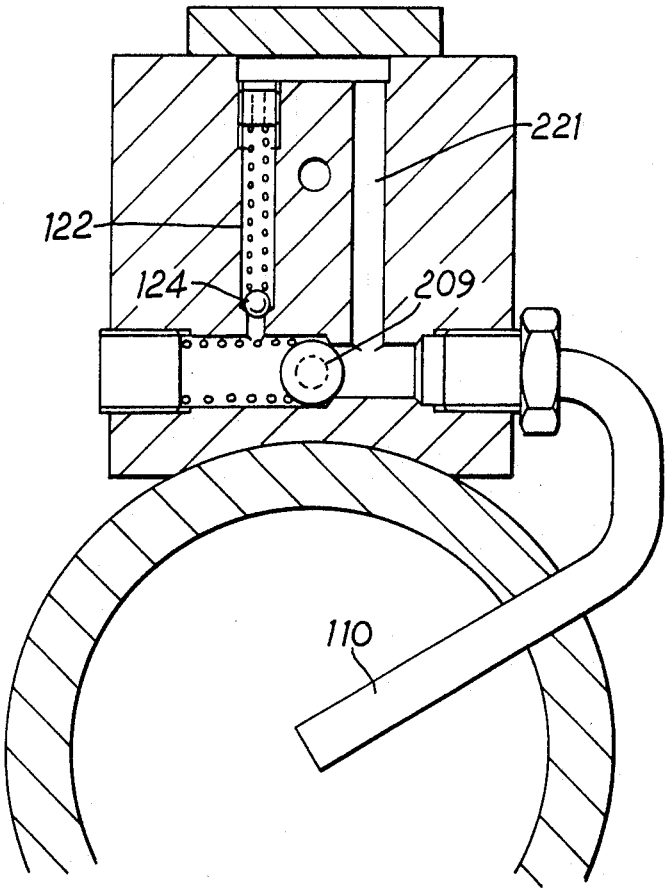
FIG. 7 is a view in section on the line B—B of FIG. 6.

The second illustrative apparatus may, if desired, comprise first and second pumps, as in the case of the first illustrative door jack; however, the second illustrative door jack shown in the drawings comprises a single pump together with a control valve system 200 adapted to ensure that the first actuator 13 is operated to firmly engage the claws. 5, 6 between the door and frame before the second actuator 8 is operated (see FIGS. 6 and 7). The control valve system comprises an inlet pipe 110 from the reservoir 20 in the cylinder of the second hydraulic actuator 8 to a chamber 112 and thence to a chamber 206 in a valve block 114. Plunger 205 is mounted in the valve block 114 for reciprocating movement by means of an operating handle 18 to be inserted (or secured) in an appropriate socket 116 pivotally mounted on the body 114 and which is pivotally connected to the plunger 205. The plunger 205 is hollow and a ball valve 212 is mounted within the plunger 205 to seat against a passage 118 from the chamber 206 to the interior of the plunger 205. A spool 214 is likewise mounted within the plunger 205. A groove surrounds the plunger 205 and communicates with the interior of the plunger, adjacent the ball valve 212. A seal 120 is positioned on the plunger 205 between the chamber 206 and the groove 215. The groove 215 communicates with a gallery 216 in the block 114 leading to a chamber 217 associated with a bypass valve 12 and thence to a pipe 218 leading to the actuator 8.

The chamber 112 also communicates via a ball valve 210, with a port 211 connected with the actuator 13. A chamber 122 (see FIG. 7) including a spring loaded ball valve 124 provides a check valve 23 connecting the pressurized chambers of the first and second hydraulic actuators. 13, 8 as in the first illustrative apparatus.

The bypass valve 12 comprises a release knob 201 arranged to operate a valve member 202 and further includes a spring loaded ball valve 203. The valve 202 and ball valve 203 both communicate with the gallery 216.

In the operation of the control valve system, with the release knob 201 screwed out fully, the valve 202 is closed and the ball valve 203 seated. Movement of the operating handle 18 to withdraw the plunger 205 from the chamber 206 causes fluid to be withdrawn from the reservoir 20 along the pipe 110 passed a ball valve 209 and into chamber 112 and thence to chamber 206. Return movement of the operating handle 118 forces the plunger 205 into the chamber 206 expelling fluid from the chamber 206 passed the ball valve 210 (the valve 209 being thus closed) into the pressurized chamber of the actuator 13 via the port 211. Repeating this operation causes extension of the actuator 13 until both claws. 5, 6 are fully engaged in a door frame.

Further operation of the handle 18 to operate the plunger 205 against the resistance of the door frame causes pressure to rise in the chamber 206 until, when it exceeds a predetermined level, the ball valve 212 opens against the spring 213 allowing fluid to pass through the passage 118 and the interior of the plunger 205 into the groove 215 and thence through gallery 216, chamber 217 and port 218 into the pressurized chamber of the actuator 8, at the opposite side of the piston **8*b* from the reservoir 20. When the plunger 205 is withdrawn from the chamber 206 on the section stroke, the spring 213 returns the spool 214 and valve 212 thus enabling the chamber 206 to fill with hydraulic fluid. However, when the arm 7 moved by the actuator 8 meets resistance when it engages the door, the pressure level in the actuator 8 and the port 218 increases and each inward stroke of the plunger 205 muse generate sufficient pressure in the chamber 206 to open the ball valve 212. The area of the ball valve 212, open to fluid pressure through the passage 118 is approximately 10% of the area of the face of the spool 214 facing the passage 218 thus, once the pressure in the actuator 8 reaches approximately 10% of the pressure level required to open the ball valve 212, the spool 214 will be held against a stop 219 in the plunger 205 and the ball valve 212 will be returned to seal the passage 118 by a light spring 220 of the spool 214. Operation thus requires only that the plunger 205 generates sufficient pressure to move the arm 7. For example, in the absence of the spool 214 if a pressure of 100 bar is required to open the valve 212 and 100 bar is required to move the door then a pressure of 200 bar would have to be generated in the chamber 206. When the arm 7 is retracted and the pressure in the pressurized chamber of the actuator 8 is nil the pressure at which hydraulic fluid will be transferred passed the valve 212 slightly exceeds the level required by the actuator 13** to create sufficient clamping force against a door frame to hold the jack in position.

When reactions to the door jacking forces are transferred to the second illustrative jack to the frame, deflection may occur requiring increased clamping force for the claws. 5, 6. The valves 203, 210 are thus so arranged that, should the pressure level in the pressurized chamber of the actuator 8 exceed the pressure in the pressurized chamber of the actuator 13, fluid is able to pass ball valves. 203 and 210 and create a compensating force to the claws 5, 6. However, should the pressure in the pressurized chamber of the actuator 8 fall, for example in the event of the door opening, the ball valves. 203, 210 will prevent a flow from the actuator 13 and the second illustrative jack will remain in position until it is released.

Once forced entry is achieved, the operating knob 201 may be screwed in to lift the valve 202 from its seat and ventilate the chamber 217 and thus depressurize chamber of the actuator 8 via the port 218 and galleries 221 to the reservoir through the pipe 110. Further screwing in of the knob 201 lifts the ball valve 203 off its seat, by the pin 222, thus allowing hydraulic fluid from the actuator 13 to pass to the reservoir 20 in similar manner. This arrangement avoids the possibility of the claws 5, 6 disengaging before the load is removed from the door.

For use in opening doors in prisons a robust jack is necessary to deal with the potentially heavy work of overcoming prison cell door barricades such a jack will usually require only a fixed retracted spacing between the claws 5, 6 because the doors to be opened in a particular prison will normally all be of the same dimensions and thus no need for an adjustable width jack arises and the first illustrative jack is especially suitable. On the other hand, for use by the police or fire service to open a variety of doors means for adjusting the spacing between the claws 5, 6 when in the retracted position is necessary to deal with the wide variety of door widths which may be encountered. Furthermore, a much lighter lower-thrust door jack may be required, operable by relatively untrained operatives and easily handled over rough ground and in a variety of situations with relative silence in operation and a minimum of delay in opening a door once a jack has been deployed. Thus the second illustrative jack using a single lever hand pump with a control valve system ensuring automatic change over when pumping for transfer of hydraulic fluid from the actuator 13 to the actuator 8 once a predetermined door frame clamping force has been achieved is important and the second illustrative jack is useful. However, where a known set of doors is to be dealt with and where the forces required to open the doors are likely to be larger, it is preferable to use a two pump system for example as described with reference to the first illustrative door jack.

In a modified valve system, instead of a bypass valve 12 operated by a screw knob 201, the valve member 202 may be spring loaded to its closed condition and positioned with a rod of the valve projecting from the casing 4 so that when the operating handle 18 is stowed in its inoperative, carrying position, the handle 18 engages the projecting portion of the pin and urges the valve members 202, 203 to their open positions, thus depressurizing the actuators. 13, 8. Upon removal of the operating handle to the operating position, the valves 202, 203 are urged by the spring to the closed positions thus automatically ensuring that the door jack is in an operative condition.

The illustrative door jacks are relatively easy to manipulate and to carry from a remote storage location to a position at which it is required to open doors. The illustrative jacks are relatively simple and quick to place in position and to operate to open the doors and, once a door has been forced open, do not unduly obstruct the opening through which a man muse pass in order to gain access to the room beyond the door.

I claim:

1. A device suitable for use in applying pressure to a closed door comprising:

a main frame;

a hydraulic fluid reservoir;

a first engaging member secured to the main frame and so arranged so as to be capable of engaging a first side of a door frame when the device is presented to the door;

a first hydraulic actuator mounted on the main frame;

a second engaging member in mechanical communication with said first actuator so as to be capable of being urged by said first actuator to engage a second side of the door frame which is opposed to said first side;

an arm pivotably mounted on said main frame between a retracted position and an operative position in which said arm projects beyond a plane defined by said first and second engaging members;

a second hydraulic actuator capable of urging said arm from its retracted position to its operative position to urge an end portion of said arm into engagement with the door thereby applying a force to the door to urge it open;

a holding chamber in fluid communication with said fluid reservoir and said first and second actuators;

a reciprocating plunger with a face and a back, said face being in fluid communication with said holding chamber and said first hydraulic actuator, said back being in fluid communication with said second hydraulic actuator;

a means for moving said plunger away from said holding chamber to create a suction force therein and toward said holding chamber to create a pressure force therein;

a first valve means positioned in the fluid line between said holding chamber and said fluid reservoir for allowing hydraulic fluid to flow into said holding chamber when said reciprocating plunger generates a suction force in said holding chamber while preventing hydraulic fluid from flowing out of said holding chamber back to said reservoir;

a second valve means positioned in the fluid line between said ;holding chamber and said first actuator for allowing hydraulic fluid to flow from said holding chamber to said first actuator, while preventing fluid flow in the opposite direction, when said reciprocating plunger generates a pressure force in said holding chamber which is greater than a first preselected value;

a third valve means positioned in the fluid line between said holding chamber and said second actuator for allowing hydraulic fluid to flow from said holding chamber to said second ;hydraulic actuator when said reciprocating plunger generates a pressure in said ;holding chamber which is greater than a second preselected value, said second preselected value being greater than said first preselected value; and a fourth valve means for allowing hydraulic fluid to flow from said second actuator to said first actuator, while preventing fluid flow in the opposite direction, when the pressure in said second actuator becomes greater than the pressure in said first actuator.

* * * * *